US008910966B1

(12) United States Patent
Rogers

(10) Patent No.: US 8,910,966 B1
(45) Date of Patent: Dec. 16, 2014

(54) SNOW SKI AND SNOWBOARD WING

(71) Applicant: Brian M. Rogers, Highland Ranch, CO (US)

(72) Inventor: Brian M. Rogers, Highland Ranch, CO (US)

( * ) Notice: Subject to any disclaimer, the term of this patent is extended or adjusted under 35 U.S.C. 154(b) by 0 days.

(21) Appl. No.: 14/244,429

(22) Filed: Apr. 3, 2014

(51) Int. Cl.
*A63C 5/04* (2006.01)
*A63C 5/06* (2006.01)

(52) U.S. Cl.
CPC ..... *A63C 5/06* (2013.01)
USPC ..... 280/609; 280/602

(58) Field of Classification Search
CPC ..... A63C 5/00; A63C 5/003; A63C 5/006; A63C 5/03; A63C 5/04; A63C 5/052; A63C 5/06; B62B 13/00; B62B 13/02; B62B 17/02; B62B 17/04; B62B 17/06
USPC ..... 280/602, 607, 609, 11.18, 613, 618, 280/809, 28, 28.14, 28.15, 28.16
See application file for complete search history.

(56) References Cited

U.S. PATENT DOCUMENTS 6,857,641 B2 * 2/2005 Bobrowicz ..... 280/14.21

FOREIGN PATENT DOCUMENTS

EP 162012 A1 * 11/1985 ..... A63C 5/075

OTHER PUBLICATIONS

Mechanical translation of EP 162012 A1, Nov. 1985.*

* cited by examiner

*Primary Examiner* — John Walters
(74) *Attorney, Agent, or Firm* — Patent Law Offices of Rick Martin, P.C.

(57) ABSTRACT

A foil wing for creating lift force on snowboards and skis is disclosed. By use of this invention on skis or snowboards, the act of translating through powder creates the necessary lift force on the leading end and down force on the aft end that is required to stay afloat in powder. The snow wing generates lift upon need when the snow gets deep enough. Therefore, the rider is kept afloat in unforeseen loose-snow areas, carrying him safely over and out. On overall snow powder days, the use of this invention keeps riders from tiring so quickly and, therefore, makes the rider more in control, and thus safer.

16 Claims, 4 Drawing Sheets

SNOW SKI AND SNOWBOARD WING

CROSS REFERENCE APPLICATION

This application is a non-provisional application claiming the benefits of provisional application No. 61/925,020 filed Jan. 8, 2014.

FIELD OF INVENTION

The present invention relates to attaching a wing(s) on top of a snow ski or snowboard to provide lift while skiing and snowboarding through deep powder.

BACKGROUND OF THE INVENTION

When snowboarding in snow powder conditions, the rider must use a riding stance with the majority of weight on the trailing/aft leg and apply an upward pull with the leading foot. This creates a forward-tip-up and back-end down condition that is required to stay "afloat" in the powder while translating forward and particularly downhill. If this "nose-up" condition is lost, the board will nose-dive into the powder, taking the rider down as well. This causes falls, forward flips, and in extreme cases becoming completely submerged in the snow. All these conditions pose danger to the rider. For skis the rider uses a weighted heel pressure to keep the tips up.

In addition to the "powder day" wherein fresh snowfall abounds, this invention can also have practical merit on days where there is not fresh powder. Often tree-wells and other local areas of loose, unpacked snow are scattered throughout snowsport areas. These locations are nearly impossible to identify from the surface, and a skier or snowboarder may inadvertently steer into one. The rider is therefore unprepared and not in a "nose-up stance, and will nose-dive and fall into the loose snow well. This is dangerous and potentially life-threatening.

A modern (current) snowboard or ski has only the bottom surface acting against the snow. These devices are not shaped to create the large leading-end lift, aft-end down forces. These forces are up to the rider to provide.

By use of this invention for skis or snowboards, the act of translating through powder creates a lift force on the leading end and down force on the aft end so as to help stay afloat in powder. The snow wing generates lift when the snow gets deep enough, therefore, the rider is kept afloat in unforeseen loose-snow areas, carrying him safely over and out.

On freshly fallen snow powder days, the use of this invention keeps riders from tiring so quickly and, therefore, makes the rider more in control, and thus safer.

SUMMARY OF THE INVENTION

The main aspect of the present invention is to provide a wing mounted above a tip and/or a tail of a snowboard or a snow ski so as to provide a lift force on the tip or a downward force on the tail while traversing through deep powder.

Another aspect of the present invention is to integrate the wing with a snowboard binding.

Another aspect of the present invention is to provide a vertical mounting strut for the wing directly on the snowboard or ski.

Another aspect of the present invention is to provide a variety of wing shapes.

Another aspect of the present invention is to provide a removable wing.

The snow wing implemented on skis and snowboards is a snowsports application of the principle of creating upward lift force by passing a foil (aka: airfoil, hydrofoil) thru a fluid medium. As in all foils, this is accomplished by the geometry of the foil and angle of attack creating a pressure differential across the lifting (top) surface and the bottom surface of the foil when immersed in and translated through a fluid medium. Literature abounds on the principle of lift produced from foils, however, this invention pertains to that application as a lift enhancement to skis, snowboards, and ski-like equipment by means of an additional force-inducing and control surface above the ski, snowboard, or ski-like equipment.

In this application, the fluid medium is snow, ideally powder, freshly fallen, and having a non-hardpacked density. This mixture of both snow (water) and air in powder conditions would make both the terminology airfoil and hydrofoil technically correct. The term powder will be used to mean snow of less-than-hardpacked density.

The snow wings installed as described herein create a lifting upward force on the leading end of the snowboard or ski, and a downward force on the trailing/aft end of the snowboard or ski when the snow wing is immersed in powder. This aids the rider in the front-end-up condition as well as the back-end-down condition. It also grants more control authority by enacting multiple acting surfaces. The claimed invention differs from what currently exists. Current skis and snowboards have only 1 control surface, the snowboard or ski itself, to react against the snow and therefore turn, or in the case of powder—stay afloat. This snow wing is a separate and additional surface to the board or ski that can push the snow during turns or adjusting depth within the snow. This aides the rider in executing maneuvers and turns as well as applying forces to stay afloat in powder.

Relying on the rider to pull up on the leading end can fatigue the skier or snowboarder, and control is then compromised, endangering themselves and others nearby. Unforeseen loose-snow areas are not identified by the rider until it is too late, and modern skis and snowboards allow them to nose-dive. By use of this invention on skis or snowboards, the act of translating through powder creates the necessary lift force on the leading end and downward force on the aft end that is required to stay afloat in powder without active input from the rider. The snow wing generates lift upon need when the snow gets deep enough. Therefore, the rider is kept afloat in unforeseen loose-snow areas by the lift force of the wing, carrying them safely over and out. On freshly fallen snow powder days, the use of this invention keeps riders from tiring so quickly and therefore makes the rider more in control, and thus safer.

How the Invention Works:

The snow wing is used to provide positive (upward) lift on the forward/leading end of the snowboard (or ski) to keep the front tip up. This is accomplished by installing the forward snow wing with a positive (nonzero, non-negative) angle of attack. While a symmetrical (non-cambered) snow wing (or flat or bent plate) would accomplish lift with a positive angle of attack, the design is optimized by using a cambered (non-symmetrical) snow wing. The lesser designs still work under this definition, however they produce unnecessary drag and stall characteristics.

When the snow wing is immersed in snow (meaning the rider has sunk to the minimum required depth in the loose snow such that it flows under and over the foil), like the wings of an airplane, the snow wing generates lift force (upward force). This lift force transmits to the snowboard or ski by a sufficiently rigid (vertical or angled) member, thus lifting up the board and rider. The lift force is variable depending on snow density, speed, and foil geometry, however this can be optimized to suit different needs and riders. Therefore, the foil can be designed to pull the snowboard or ski up to the depth in the powder such that the foil moves upward until it sticks out into the air and lift is lost (i.e. maximum lift). Or the foil can be designed to allow the rider to float within the powder more easily (i.e. moderate lift) to conserve strength and improve control authority during turns via multiple acting surfaces, similar to a banking airplane.

A mirror-image snow wing is installed on the trailing/aft end of the snowboard. Because the angle of attack for this rear snow wing is oriented in the reverse direction (positive angle of attack facing backwards to motion equals negative angle of attack), a downward force is produced when moving through snow powder. This enhances the front-tip-up condition by forcing a back-tip-down moment about the lengthwise-center of the board (or other desired fulcrum). This invention applies as a single snow wing installed in the forward positive angle of attack implementation, a single snow wing installed in the aft negative angle of attack implementation, or ideally in the application of both implementations. In snowboarding a rider may ride either left-foot forward or right-foot forward, and often switches between the two. The ideal installation is, therefore, where the snow wing's positive angle of attack faces opposite each other and outboard of the rider. This will always result in a leading-end-up and aft-end-down condition when moving through powder.

How to Make the Invention:

After procuring the material (metal, plastic, composite, polymer) in order to fabricate the items, construction can begin. The snow wing can be machined out of the stock or injection molded to a NACA (or similar) standard airfoil profile, or any foil shape publicly available. There are many low-speed airfoil shapes defined in literature, and these are the recommended geometry given the snow application, such as the Clark-Y airfoil. The span of the wing should be at least as wide (laterally) as the board or ski, though not so long as to impact the ground during turns (banking). For the ski application, the span should not make contact with the span of the opposing leg/ski.

The vertical member is then constructed/machined/molded to attach the midspan of the snow wing (via bolts or other fastening). The member should be rigid and sufficiently strong to carry and react to the loads imparted by the snow wing. Additionally, the vertical member should not be overly deep (lengthwise to board) as this could inhibit the rotational ability of the board (i.e. boarder switching leading foot). For a ski implementation this is much less of a design impact since skiers do not typically reverse. The vertical member should be shaped to direct snow around the leg to make the skier or snowboarder more aerodynamic and reduce drag through powder.

The mounting interface is then constructed to connect the vertical member to the snowboard or ski. The attachment locations on the ski or snowboard are: the ski or board itself, the bindings, or the boots. As previously described, the mounting provisions vary with attachment location. This invention applies to a snow wing and vertical member attached to a snowboard (or binding or boots as described later) or a ski (or other ski-like or snowboard-like entity), but not the application of a snow wing attached directly to a skier or snowboarder (person), as the lift created could potentially cause injury to the attached extremity or torso.

For initial implementation, the use of the mounting interface will be necessary since modern/current snowboards/skis to not include mounting provisions for this technology. However, this is only one possible variation. In the future as the benefits of the snow wing are more widely recognized, the vertical member may become integral to the board/ski itself and constructed at the same time of the same media. Only the snow wings (optimized for a given application) can be attached and removed for other variants (increase lift, decrease lift, etc.). Ultimately, another variation may be that the entire snow wing and vertical member assembly becomes one solid piece constructed to the snowboard or ski. This implementation would focus on specific applications since the snow wing would not be able to be modified as conditions change (i.e. angle of attack, larger wing, etc.). The design could be enhanced for a given application by selecting the proper foil shape, lift area, span, and angle of attack. Other upgrades could include winglets, or coatings to the snowfoil and vertical member to make it more aerodynamic.

This invention and the desired effect it produces is achieved by a foil (or surface, flat or curved) in a wing-like installation attached to a snowboard or ski. Therefore, any wing-like snowfoil (airfoil, hydrofoil) attached to the snowboard or ski in this manner is within this domain. Based upon average snow density in different regions, expected velocity during use, personal skill level, magnitude of forces desired, and other factors, the variables of typical wing design can be adjusted for the desired outcome, but are all within this design space. These attributes include, but are not necessarily limited to varying: foil geometry including profile, symmetry or asymmetry, camber, chord, platform area, aspect ratio; foil installation including angle of attack, straight wing, swept wing, variable wing, delta wing, and bi-foil and multi-foil (aka bi-plane, tri-plane, sesquiplane) implementations; additions including winglets and control surfaces. As stated before, the design can be optimized for use in all ski-snowsports including snowblades, sleds, snowboards, and the skis used on snowmobiles given its ubiquitous effect and inherent safety characteristics.

How to Use the Invention:

The vertical member is attached to the board/ski (or binding, or boot). Then the snow wing is attached to the vertical member. This installation is done with the leading edge of the wing pointing away from the rider towards the edge of the ski or snowboard. Similarly the positive angle of attack should face away from the rider, and towards the end of the board. This creates a mirror image installation of the new wings. Then, when motion is applied the angles of attack of the snow wings create the desired lead-up/aft-down effect. This enables the lift-generated forward-tip-up ability when traversing loose snow and powder.

By simply entering snow deep enough that the snow wing becomes immersed, the desired effect is created, and the rider is saved from fatigue or control loss from "nosing down".

The only related prior art known is a waterski (U.S. Pat. No. 6,056,311) having a built in wing on the bottom surface.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
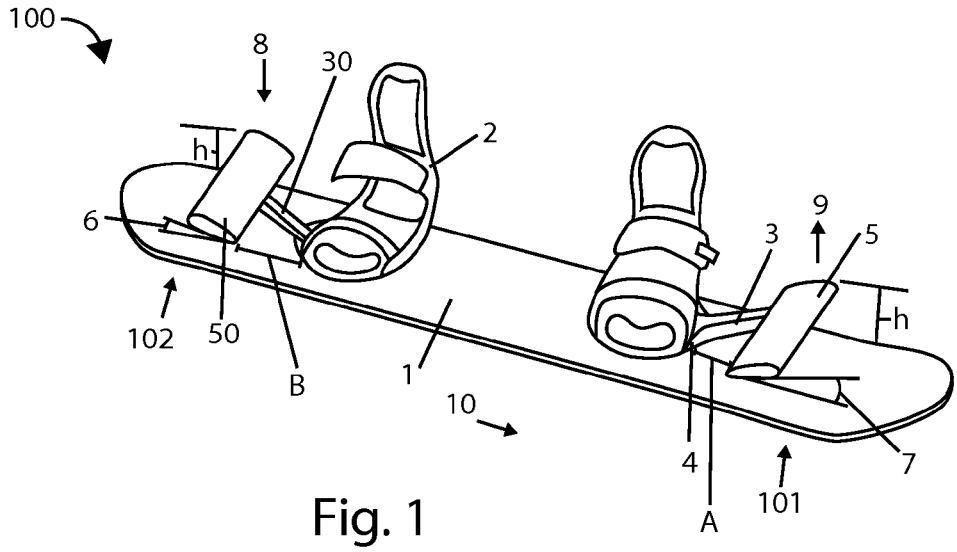
FIG. 1 is a top perspective view of a snowboard embodiment with the wings attached to the bindings.

Referring first to FIG. 1 a snowboard 100 travels forward in direction 10. The front binding 4 is mounted on a front segment 101 of the snowboard 100. The rear binding 2 is mounted on the rear segment 102 of the snowboard 100. The bindings 2, 4 are mounted on the top surface 1 of the snowboard 100. The forward wing 5 is mounted a height h above the top surface 1. It has an acute angle of attack 7 so as to exert an upward force 9 on the front segment 101 when traveling through powder that is higher than height h. A mounting strut 3 is attached to the binding 4 so as to affix the forward wing 5 in place.

The rear wing 50 has a mounting strut 30 which is affixed to rear binding 2. Rear wing 50 has a reverse angle of attack 6 so as to exert a downward force 8 on the rear segment 102 when the snowboard 100 is traveling through powder snow which is higher than height h. The mounting struts could be built integral to the bindings 2, 4. The mounting struts 3, 30 each traverse upward from the top surface 1 at an acute angle, A, B.

Figure 2:
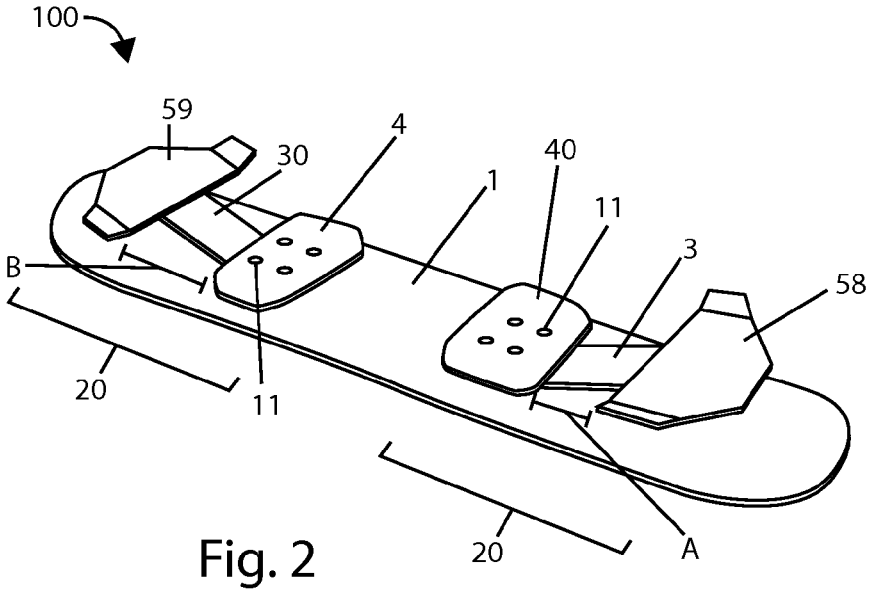
FIG. 2 is a top perspective view of the FIG. 1 embodiment with the bindings removed.

Referring next to FIG. 2 wing assemblies 20 allow a traditional snowboard and binding combination to be quickly upgraded to include wings 58, 59 (which are shown as a wing tip foil type). Each wing assembly 20 has a mounting plate 40 which has holes 11. These holes 11 allow binding bolts to pass there through and fasten in a traditional manner to anchors supplied in the snowboard 100. The mounting struts 3, 30 are built into the mounting plates 40.

Figure 3:
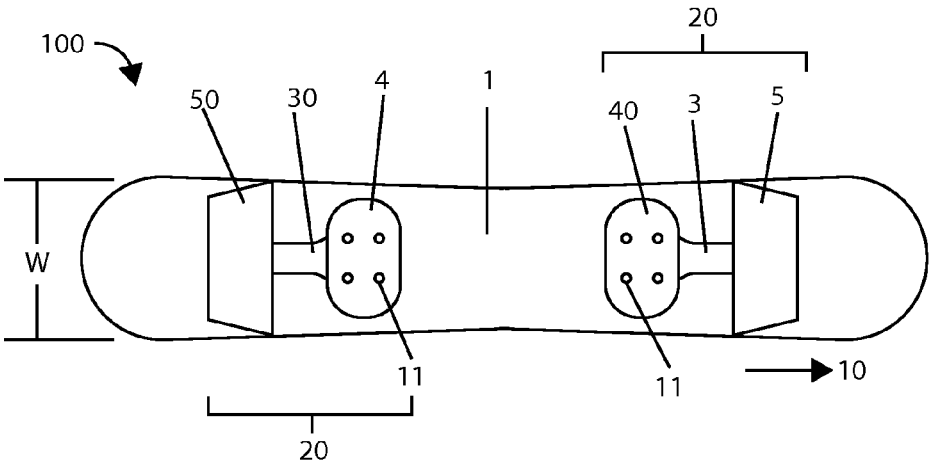
FIG. 3 is a top plan view of the FIG. 2 embodiment.

Referring next to FIG. 3 the wings 5, 50 preferably have a transverse width w about equal to the width of the snowboard 100. Design choice could widen the wings, but they should not interfere with the ground as the rider tilts the snowboard 100.

Figure 4:
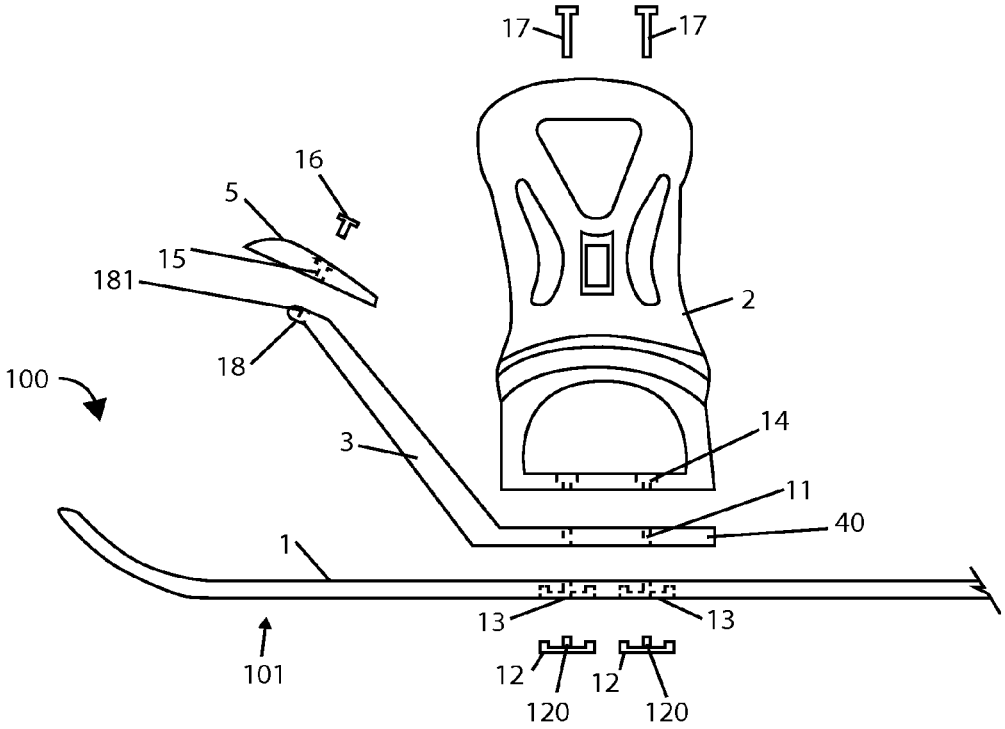
FIG. 4 is a right side elevation view of the FIG. 1 embodiment.

Referring next to FIG. 4 prior art anchors 12 fit into inserts 13 integral within snowboard 100 in a known manner. Each anchor 12 has a threaded boss 120 to receive bolts 17.

Bolts 17 pass through binding holes 14 then through mounting plate holes 11, and then into bosses 120.

Mounting strut 3 has a mounting flang 18 with a boss 181 which provides a removable mount for the wing 5 via bolt 16 passing through hole 15 and into the boss 181.

Figure 5:
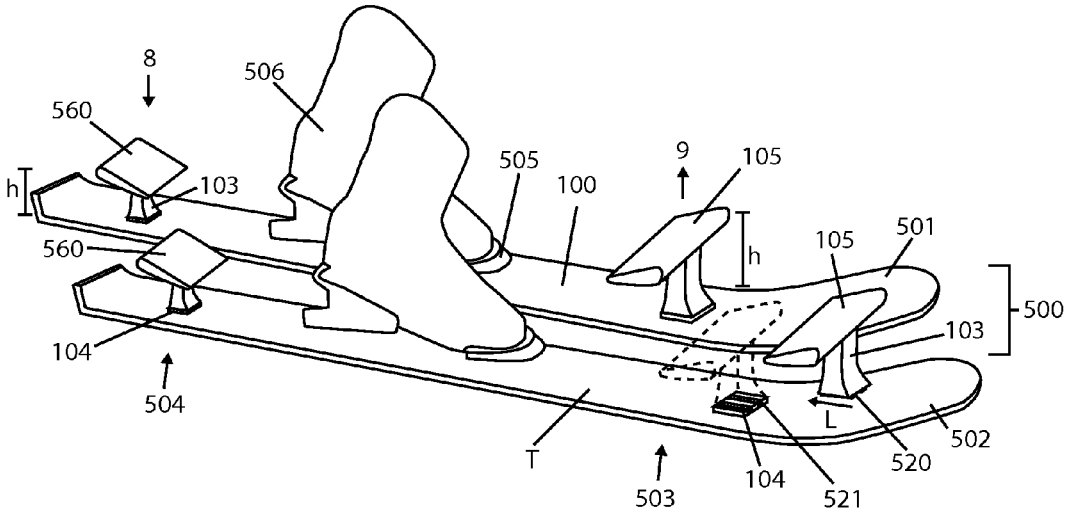
FIG. 5 is a front elevation view of a board mounted ski embodiment.

Referring next to FIG. 5 a pair of downhill snow skis 500 consists of a left ski 501 and a right ski 502. The front segment of the skis is designated 503, and the rear segment is designated 504. The bindings 505 secure the boots 506 to the skis 500 in a known manner. A front wing 105 provides a lift force 9 on the front segment 503 when the skis travel through powder snow that is higher than height h. A vertical strut 103 anchors to the top T of the ski 502 by means of a tongue in groove mount 104. Arrow L shows the motion to lock tongues 520 on the bottom of strut 103 into grooves 521 in anchor 104. Thus, the strut 103 is removable. The wing 105 may be removable to allow a choice of wings such as shown in FIGS. 6-9. The strut 103 could be integrated into the binding 505 during manufacturing.

Rear wings 560 provide a downward force 8 on the rear segment 504 of the skis 500 when traveling through powder that is higher than height h.

Figure 6:
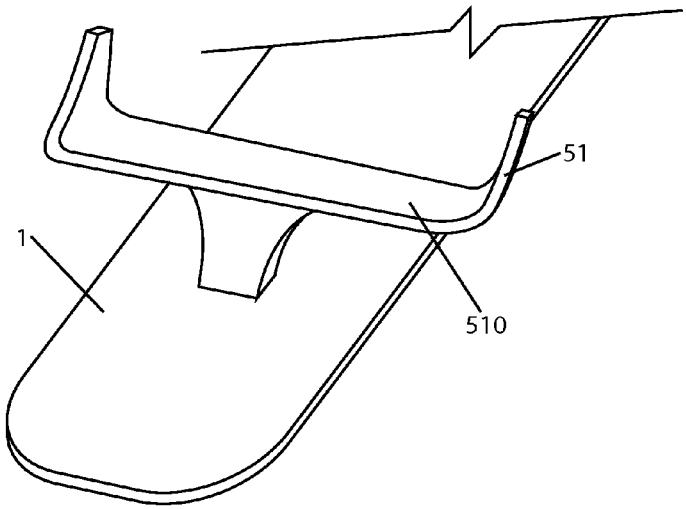
FIG. 6 is a front perspective view of a winglet embodiment.

FIG. 6 shows a curl up foil 51 on wing 510.

Figure 7:
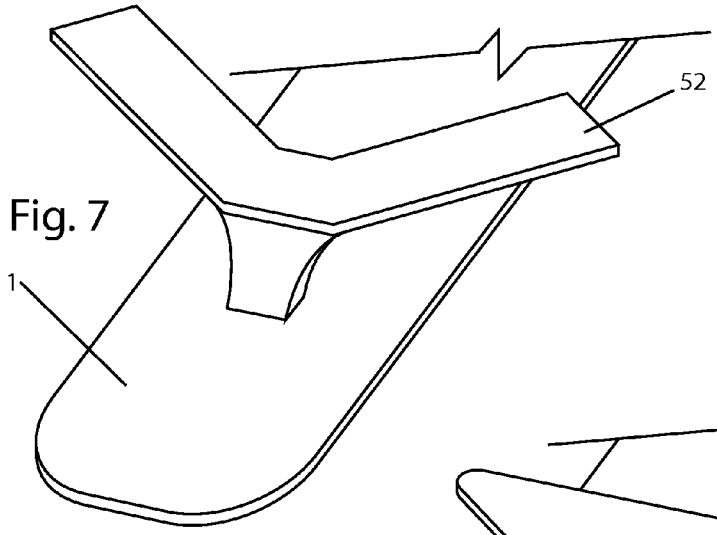
FIG. 7 is a front perspective view of a swept wing embodiment.

FIG. 7 shows a swept back wing 52.

Figure 8:
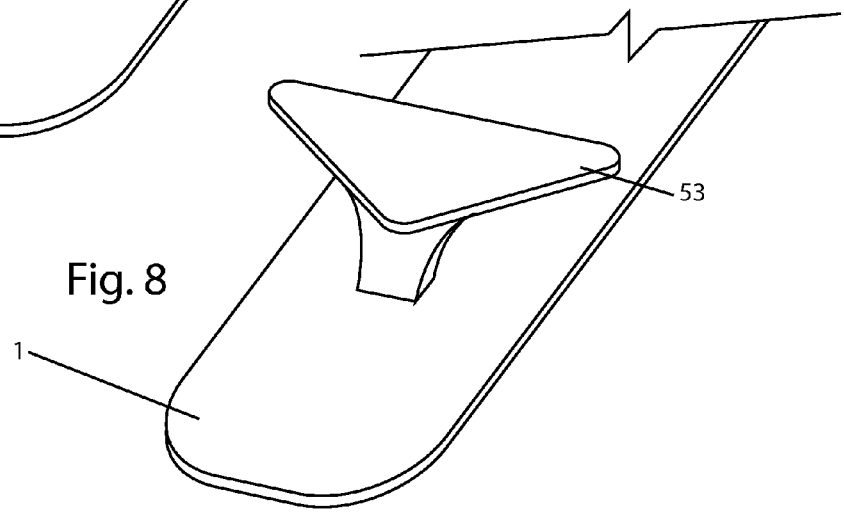
FIG. 8 is a front perspective view of a delta wing embodiment.

FIG. 8 shows a delta shaped wing 53.

Figure 9:
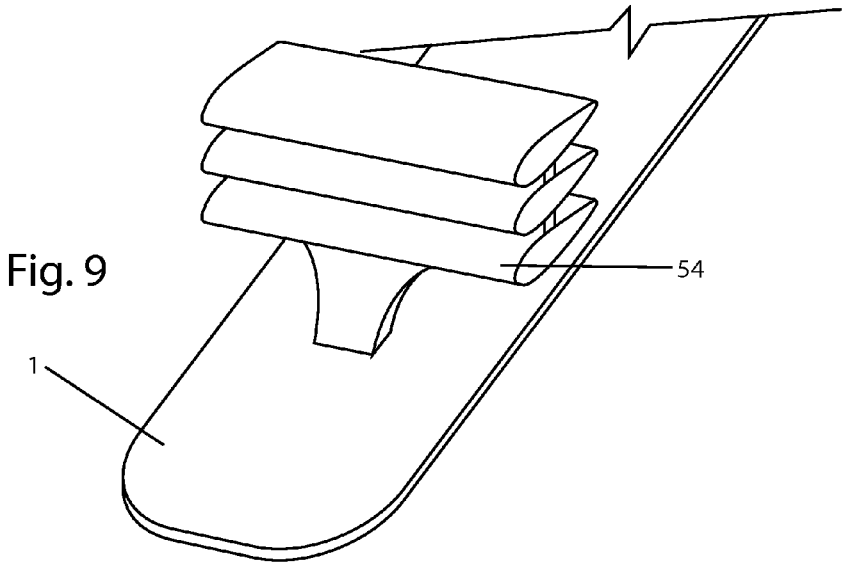
FIG. 9 is a front perspective view of a tri-foil embodiment.

FIG. 9 shows a tri-foil wing 54.

The present invention covers any shaped wing that provides lift or downward pressure on top surface 1 (of any snow ski or board), depending on angle of attack and location on the ski or board.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A snowboard comprising:

a bottom riding surface;

a top surface having a front and a rear binding for a pair of boots;

a front mounting strut in front of the front binding having a mounting means functioning to secure the mounting strut to the top surface;

said front mounting strut having a top segment located above the top surface;

said top segment securing a wing thereto;

said wing having a transverse body shape relative to a longitudinal axis of the snowboard; and wherein said wing provides a lift force to a front segment of the snowboard when the snowboard travels through powder snow which is at a height above the wing.

2. The snowboard of claim 1, wherein the mounting means further comprises an anchor on the top surface of the front segment of the snowboard.

3. The snowboard of claim 1, wherein the mounting means further comprises a strut mount plate fastened to the snowboard under the front binding, wherein the front mounting strut extends forward from the strut mount plate at an acute angle relative to the front segment of the snowboard.

4. The snowboard of claim 1, wherein the wing further comprises a removable attachment to the mounting strut.

5. The snowboard of claim 1, wherein the wing has a transverse width about the same as a width of the snowboard.

6. The snowboard of claim 1 further comprising a rear mounting means functioning to secure the rear mounting strut to the top surface, said rear mounting strut having a top segment located above the top surface, said top segment having a rear wing attached thereto, wherein said rear wing provides a downward force on a rear segment of the snowboard when traveling through powder snow which is higher than a height of the rear wing above the top surface of the snowboard.

7. The snowboard of claim 6, wherein said rear mounting means further comprises a rear anchor on the top surface of the rear segment of the snowboard.

8. The snowboard of claim 6, wherein said rear mounting means further comprises a strut mount plate fastened to the snowboard under the rear binding, wherein the rear mounting strut extends rearward from the strut mounting plate at an acute angle relative to the rear segment of the snowboard.

9. An elongate board comprising:

a front segment with a top surface having a wing mounted above the top surface so as to produce a lift force on the front segment when traveling through snow; and a rear segment with a top surface having a rear wing mounted above the top surface so as to produce a downward force on the rear segment when traveling through snow.

10. The elongate board of claim 9 further comprising a front binding with a mounting strut securing the wing, and a rear binding with a rear mounting strut securing the rear wing.

11. The elongate board of claim 10, wherein the mounting strut and the rear mounting strut each further comprise a mounting plate under the respective binding.

12. A snow ski comprising:

a top surface;

a wing mounted above the top surface; and wherein the wing provides a lift force to the snow ski when traveling through snow which is deeper than a height of the wing above the top surface.

13. The snow ski of claim 12, wherein the ski further comprises a binding for a boot, and the wing is mounted in front of the binding, wherein the lift force is exerted on a front segment of the snow ski.

14. The snow ski of claim 13, wherein the wing further comprises a removable connecting link to an anchor on the snow ski.

15. The snow ski of claim 13 further comprising a rear wing mounted behind the binding, wherein the rear wing provides a downward force to a rear segment of the snow ski.

16. The snow ski of claim 15, wherein the wing and the rear wing each have a mount associated with the binding.

* * * * *